United States Patent [19]

Meyers et al.

[11] 4,105,154

[45] Aug. 8, 1978

[54] PACKAGING STRUCTURE AND ITS FABRICATION

[75] Inventors: George Leroy Meyers; Donald Roy Kuehl, both of Menasah, Wis.

[73] Assignee: American Can Company, Greenwich, Conn.

[21] Appl. No.: 784,828

[22] Filed: Apr. 5, 1977

[51] Int. Cl.[2] ..... B65D 5/48

[52] U.S. Cl. ..... 229/27; 229/37 R; 229/28 R

[58] Field of Search ..... 229/27, 38, 37, 28, 229/41 B

[56] References Cited

U.S. PATENT DOCUMENTS

| | | | |
|---|---|---|---|
| 2,785,844 | 3/1957 | Metzger | 229/28 R |
| 2,909,311 | 10/1959 | Levitt | 229/28 R |
| 3,135,453 | 6/1964 | Struble | 229/27 |
| 3,288,348 | 11/1966 | Brackett | 229/37 R |
| 3,575,286 | 4/1971 | Rosenburg | 229/27 |
| 3,656,612 | 4/1972 | Sellors | 229/37 R X |
| 3,731,873 | 5/1973 | Brangle, Jr. | 229/37 R X |
| 3,946,935 | 3/1976 | Bonezyk | 229/37 R |

*Primary Examiner*—Davis T. Moorhead
*Attorney, Agent, or Firm*—Robert P. Auber; Ira S. Dorman; Harry W. Hargis, III

[57] ABSTRACT

A folding paperboard carton including an interior divider is formed from a single-piece blank. The divider is attached to a flap or wall panel of the carton blank, and after the carton is glued in a folded mode, unfolding the carton to its set up mode releases the divider from its attachment to the flap or wall panel to form a divided carton.

14 Claims, 13 Drawing Figures

PACKAGING STRUCTURE AND ITS FABRICATION

BACKGROUND OF THE INVENTION

This invention relates to packaging, and more particularly to improvements in the structure and fabrication of folding-type cartons.

Folding cartons provided with divider panels and end closure flaps affixed to generally sleeve-shaped main body portions heretofore have required multiple blanks for the divider panels and the carton body portions, in concert with means for precisely aligning the divider panels for attachment to the appropriate body portions during carton assembly. The handling of multiple blanks of paperboard, or other suitable carton material, taken with the requirement for precise alignment thereof, are factors in the overall economy of assembly of this type of carton, and it is desirable that the number of blanks to be handled be held to a minimum.

It is a general objective of the invention to provide an improved folding carton structure of the divided type minimizing the number of blanks and steps required for its assembly.

It is a further objective of the invention to provide an improved folding carton structure including a divider panel using a single blank, which divider panel is automatically positionable upon unfolding the carton to its erected or set up mode.

It is another objective of the invention to provide an improved method for fabricating folding cartons of the divided type.

SUMMARY OF THE INVENTION

In achievement of the foregoing as well as other objectives and advantages, the invention contemplates a folding carton blank, and the assembly of a carton structure therefrom including a foldable sleeve-like body portion, closure portions hingedly connected to said body portion, and divider panel means for said body portion, said divider panel means including wall panels defining mutually spaced regions hingedly connected to said body portion, and means defining detachable interconnection of said divider panel means and one of said body and closure portions in a folded mode of said carton structure, said divider panel means being detachable from the recited one of said body and closure portions, and pivotable on said hingedly connected spaced regions into a position dividing the region enclosed by said sleeve-like body portion, upon unfolding of said carton structure to a set up mode.

The manner in which the foregoing objectives and advantages may best be achieved will be more fully understood from a consideration of the following description, taken in light of the accompanying drawings.

DETAILED DESCRIPTION OF THE SEVERAL EMBODIMENTS

Figure 1:
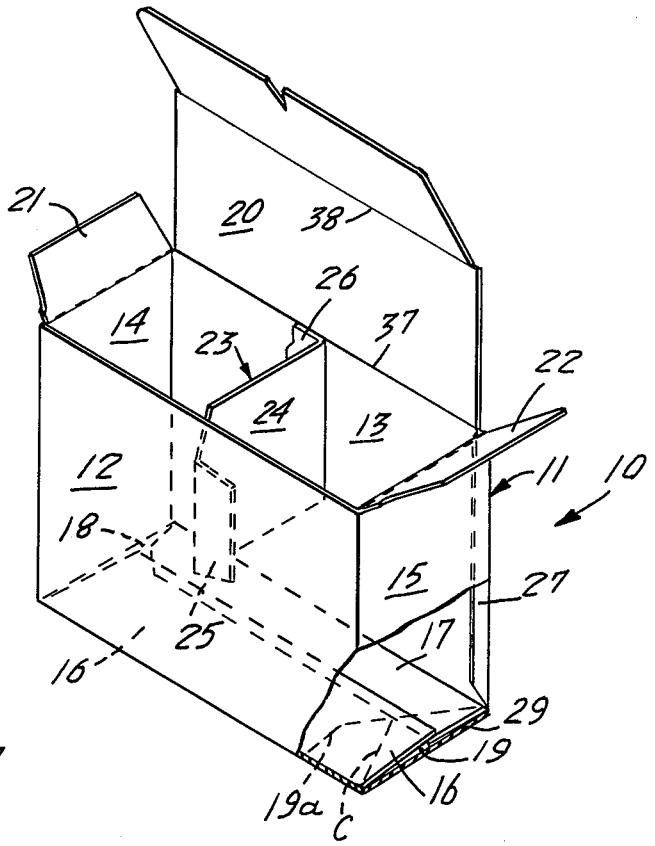
FIG. 1 is a fragmented perspective showing of a completed carton embodying one form of the invention, said carton being viewed from the front in its set up mode, and having its upper closure portions in opened position.

With more detailed reference to FIG. 1, an erected or set up folding carton, made of paperboard or any other suitable material, is designated generally by the numeral 10, and comprises a generally rectangular sleeve like body or receptacle portion 11 made up of rectangular front and rear wall panels 12 and 13, respectively and left and right side wall panels 14 and 15, respectively. The carton further is provided with closure portions including a set of overlapping bottom closure flaps 16, 17 and 18, 19, and top closure flaps 20, 21 and 22, the latter flaps being shown in open position for the sake of convenience. A divider panel means 23, having generally the shape of the letter Z, as viewed from above, includes an intermediate region or section 24 extending transversely of the opposed wall panels 12 and 13, and mutually spaced regions comprising end tabs 25 and 26 affixed to the latter panels, preferably by means of an adhesive, such as, for example, glue.

Figure 2:
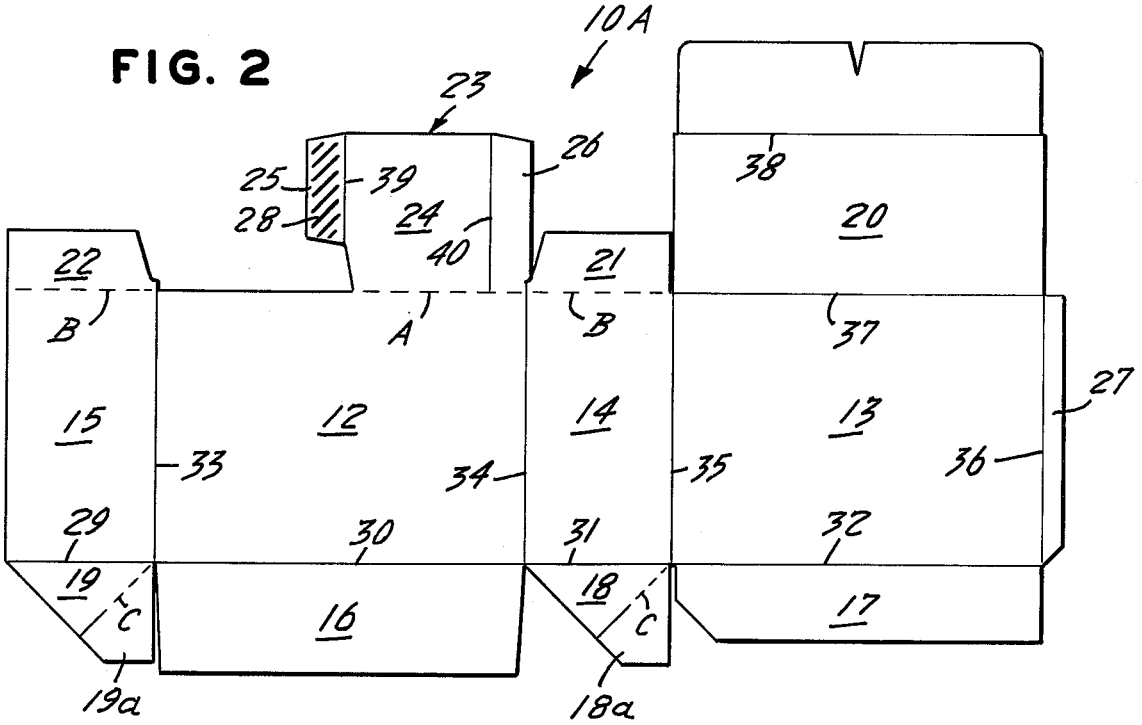
FIG. 2 is a plan view of a one-piece blank from which the folding carton of FIG. 1 is assembled.

As is seen further to advantage in FIG. 2, wherein the paperboard blank 10A for carton 10 is shown, divider panel means 23 and wall panel 12 are detachably interconnected along a score line A defining a region of weakness, such as, for example a cut score line, disposed intermediately of a central region or section 24 of divider panel means 23 and wall panel 12. Score lines B are provided between closure flaps 21, 22 and side wall panels 14, 15, respectively, and score lines C extend across trapezoidal shaped closure flaps 18 and 19, through corners and sides thereof. A flap or glue panel 27 on panel 13, and score lines 29 to 40 are provided as shown, in provision of hinged interconnections for reasons to be explained more fully in what follows.

Considering the setting up of carton 10, and beginning with disposition of the blank 10A as seen in FIG. 2, an adhesive, such as, for example, glue, is applied to tab 25, as is indicated by the stippling 28.

Figure 3:
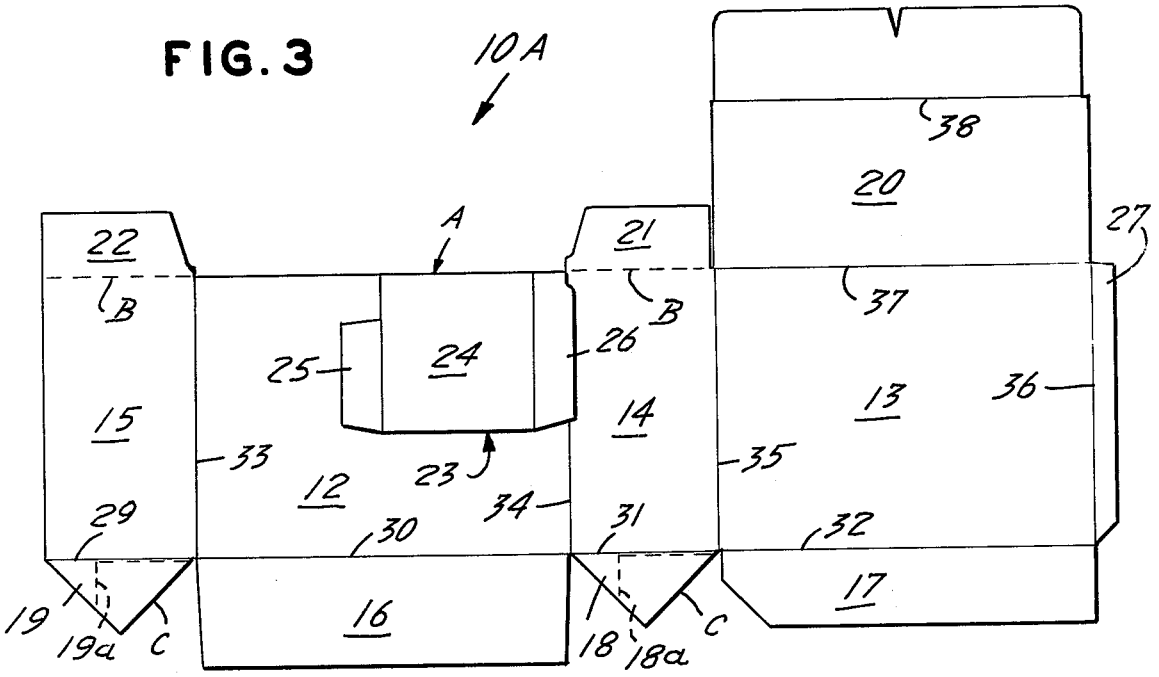
FIGS. 3 to 5 are plan views of the carton in successive steps of partial assembly.

After glue 28 has been applied, and with reference to FIG. 3, divider panel means 23 is folded along line of weakness A onto side panel 12, so that glue-bearing tab 25 adheres thereto. Also, portions **18*a* and 19*a* of flaps 18 and 19** are folded about score lines C onto the under side of the blank.

Figure 4:
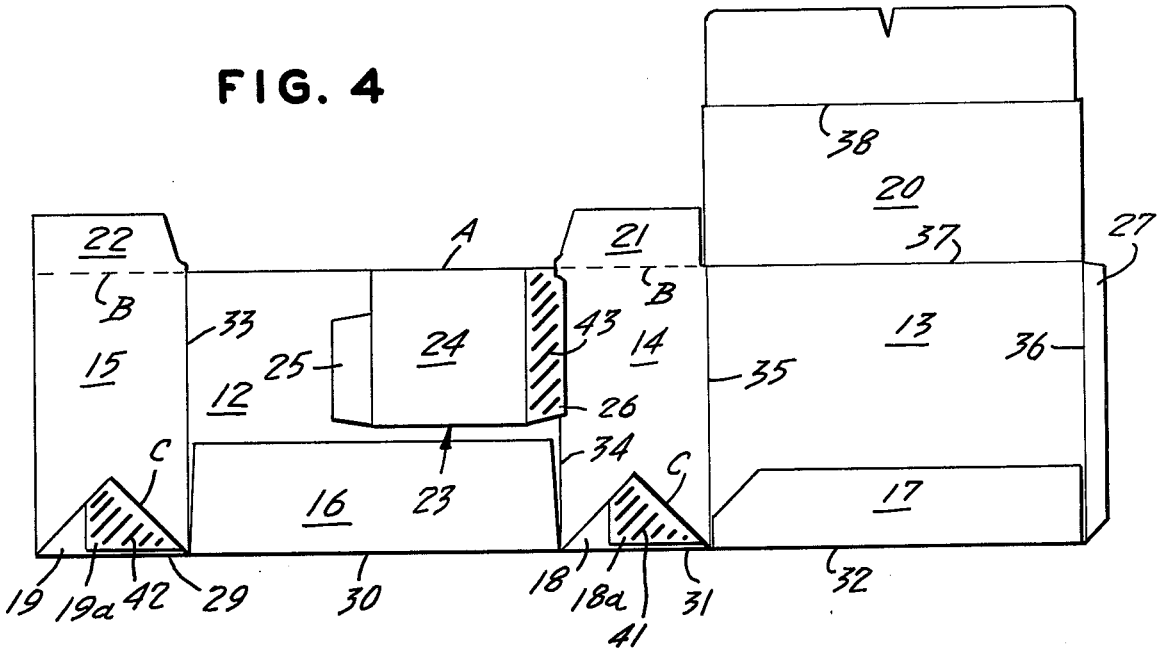

Turning to FIG. 4, folded faps 18 and 19, and flaps 16 and 17 are then folded along score lines 29, 31 and 30, 32, respectively, onto the upper surface of the blank. Glue, as indicated by stippling at 41, 42, and 43, is applied to upwardly facing surfaces of flap portions **18*a*, 19*a*, and tab 26**, respectively.

Figure 5:
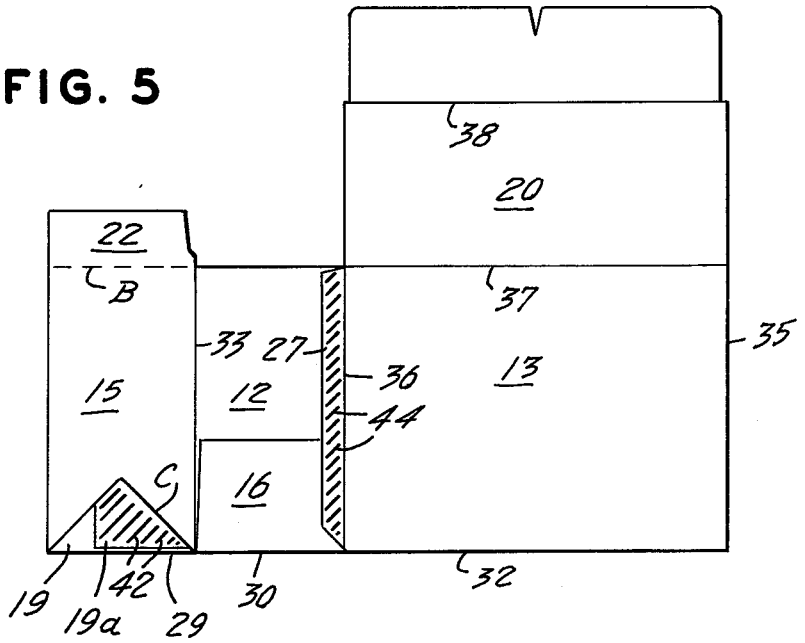

With reference to FIG. 5, wall panel 13 is folded about score line 35, from the position shown in FIG. 4 to the position shown in FIG. 5, carrying with it flaps 17 (not shown), 20, and tab 27. This folding of wall panel 13 causes it to overlie wall panel 14, and part of wall panel 12, in which position glue-bearing portion 18*a* of flap 18 (not shown) adheres to a confronting portion of flap 17 on wall panel 13. Glue 44 is then applied to the upwardly facing surface of glue panel 27, whereupon wall panel 15 is folded to the right about score line 33 over wall panel 12 and tab 27, causing glue-bearing flap portion 19*a* to adhere to a confronting region of flap 16 on wall panel 12, and glue-bearing tab 27 to adhere to wall panel 15, as is seen in FIG. 6.

Figure 6:
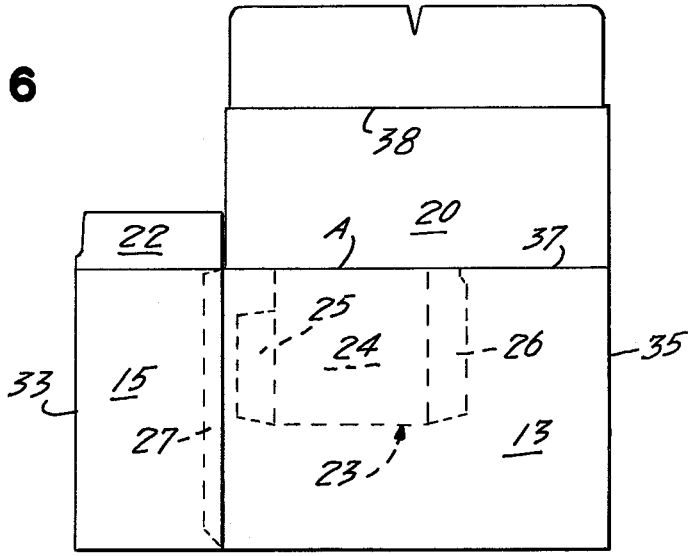
FIG. 6 is a plan view of the completed carton, as viewed from the rear, and in its folded mode prior to unfolding to its set up mode seen in FIG. 1.

The carton as shown in FIG. 6 is complete, and conveniently is seen from the rear in its folded mode, prior to its being unfolded to its set up, or erected, mode. In order better to describe an advantageous feature of the invention, divider panel means 23 is shown in broken lines in FIG. 6.

In making the transition from the folded mode to the unfolded, set up mode, the left edge of wall panel 15 (e.g. region of score line 33) and the right edge of wall panel 13 (e.g. region of score line 35), as viewed in FIG. 6, are caused to be moved toward one another, whereby panels 12 to 15 pivot along the hinged connections afforded by the several score lines 33, 34, 35 and 36 at adjacent side regions of the wall panels.

Figure 1A:
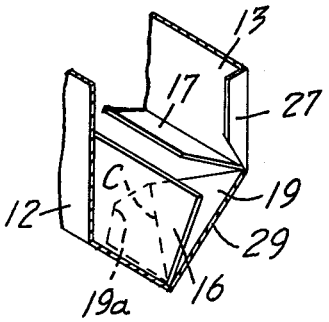
FIG. 1A is a fragmented, operational perspective view of a lower end portion of the carton, as seen in FIG. 1, and illustrating a feature of construction of the carton closure facilitating unfolding to its set up mode.

Also upon setting up the carton, and as is seen to advantage in FIG. 1A, where only one end of the carton need be shown in view of the substantially identical structures of the ends, folded closure flaps 18 and 19 unfold along their respective folded score lines C, in accordion-like manner, also pivoting about their respective score lines 31 and 29 to a substantially planar configuration, automatically pivoting attached bottom closure flaps 16 and 17 about their folded score lines 30 and 32 into overlapping, substantially coplanar position transverse to the planes of wall panels 12, 13, 14 and 15. As the carton unfolds, wall panels 12 to 15 move in such a manner as to define a series of parallelogram-shaped cross sections, as viewed from above, until the carton attains the rectangular configuration of its set up mode as is seen in FIG. 1. In the course of this unfolding sequence, and in especial accordance with the invention, the center or intermediate section 24 of divider panel means 23 is caused to rotate or pivot, relative to wall panels 12 and 13, about the hinged connections afforded by the score lines 39 and 40 taken with the adhesive attachment of tabs 25 and 26 to wall panels 12 and 13, respectively. Since this pivotal movement of section 24 is relative to wall panel 12, it is readily torn therefrom along the line of weakness A. Alternatively, and by virtue of the accessibility of line A, section 24 conveniently may be detached manually or by suitable knife means at any desired stage of assembly after the glue attachment of tab 25 to wall panel 12 (FIG. 3).

Advantageously, the disclosed combination of the several body wall panels, closure flaps, glue panels, and tabs, taken with the hinged connections afforded by the several score lines achieve a carton blank that is readily and economically assembled and set up into a divided carton structure.

In the modified embodiment of the invention shown in FIG. 7, a set up folding carton 110 essentially is identical with the carton 10 shown in FIG. 1, differing therefrom primarily in the formation of some elements of its blank, and the associated assembly steps, as will be described in connection with FIGS. 8 to 12. Still with reference to FIG. 7, carton 110 comprises generally sleeve-like body portion 111 made up of rectangular front and rear wall panels 112 and 113, respectively, and left and right side wall panels 114 and 115, respectively. Carton 110 includes also closure portions made up of a pair of overlapping bottom closure flaps 116, 117 and 118, 119, and top closure slaps 120, 121 and 122, the latter flaps being shown in open position, for the sake of convenience. A divider panel means 123, formed generally in the shape of the letter Z, as viewed from above, includes an intermediate region or section 124 extending transversely of the opposed wall panels 112 and 113, and mutually spaced regions such as end tabs 125 and 126 affixed, preferably by means of an adhesive, such as glue, as will be described in what follows, to respective wall panels 112 and 113.

Figure 8:
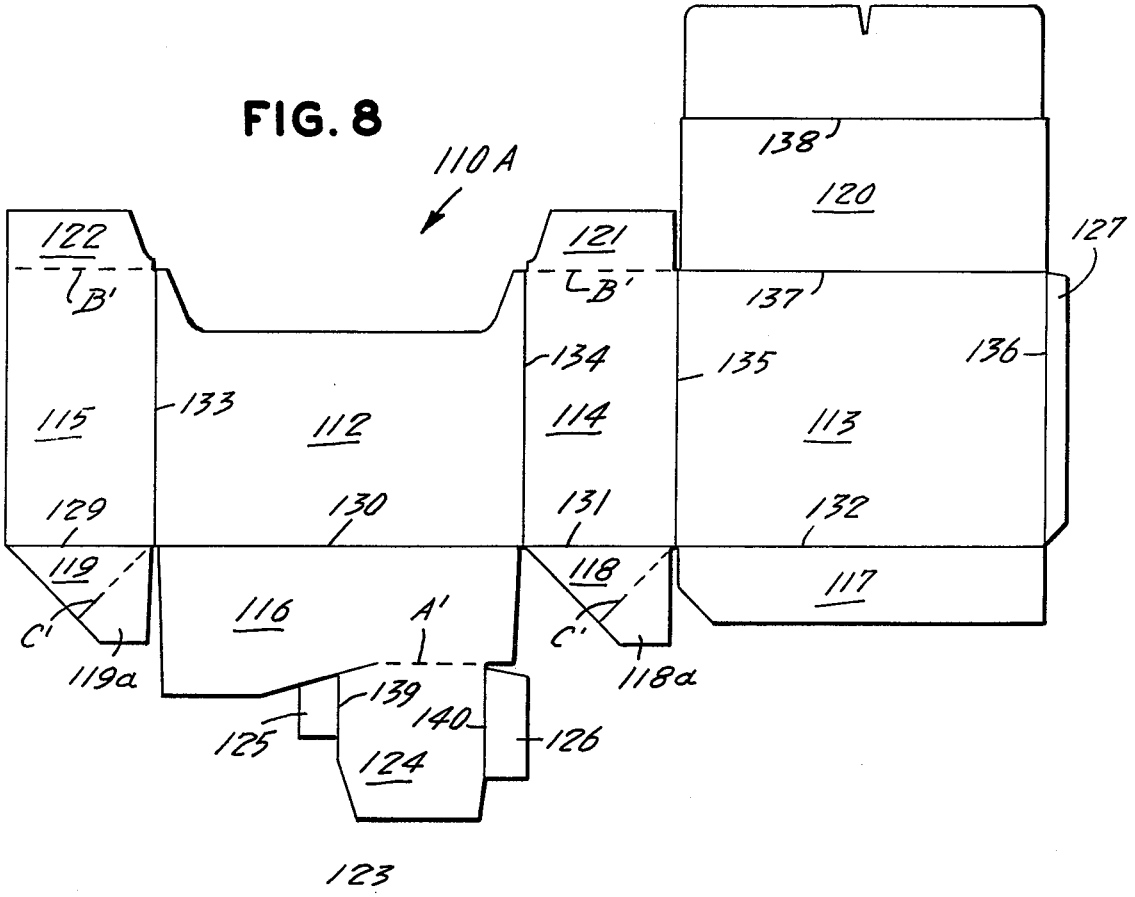
FIGS. 8 to 12 are similar to FIGS. 2 to 6, respectively, in their showings of steps for assembling the carton to its folded mode, prior to unfolding to the set up mode shown in FIG. 7.

As will be seen further to advantage in FIG. 8, wherein the blank 110A for carton 110 is shown, divider panel means 123 and bottom closure flap 116 are detachably interconnected along a line of weakness A′ disposed intermediately of the central section 124 of divider panel means 123 and closure flap 116. Score lines are provided at B′ between flaps 121, 122 and side wall panels 114, 115, respectively, and at C′ where they extend across trapezoidal shaped flaps 118 and 119, through corners and sides thereof. A flap or glue panel 127 on wall panel 113, and score lines 129 to 140 are provided for reasons to be explained more fully in what follows.

Figure 9:
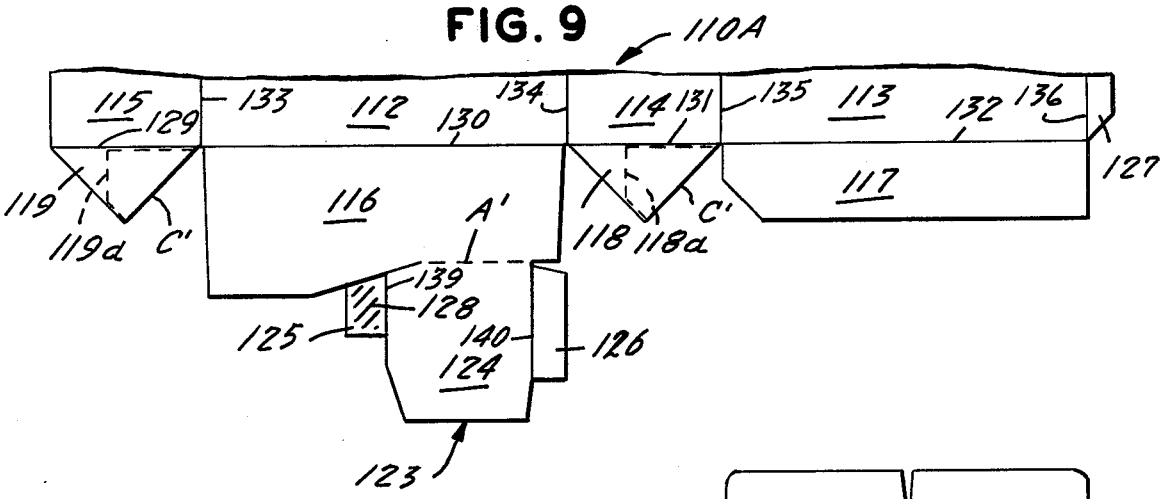

Considering the setting up of carton 110, and beginning with the disposition of the blank 110A as seen in FIG. 8, adhesive, such as, for example, glue, is applied to tab 125, as is indicated by stippling identified by numeral 128 in the fragmentary showing of FIG. 9. Also, portions 118*a* and 119*a* of flaps 118 and 119 are folded about score lines C′ onto the under side of the blank.

Figure 10:
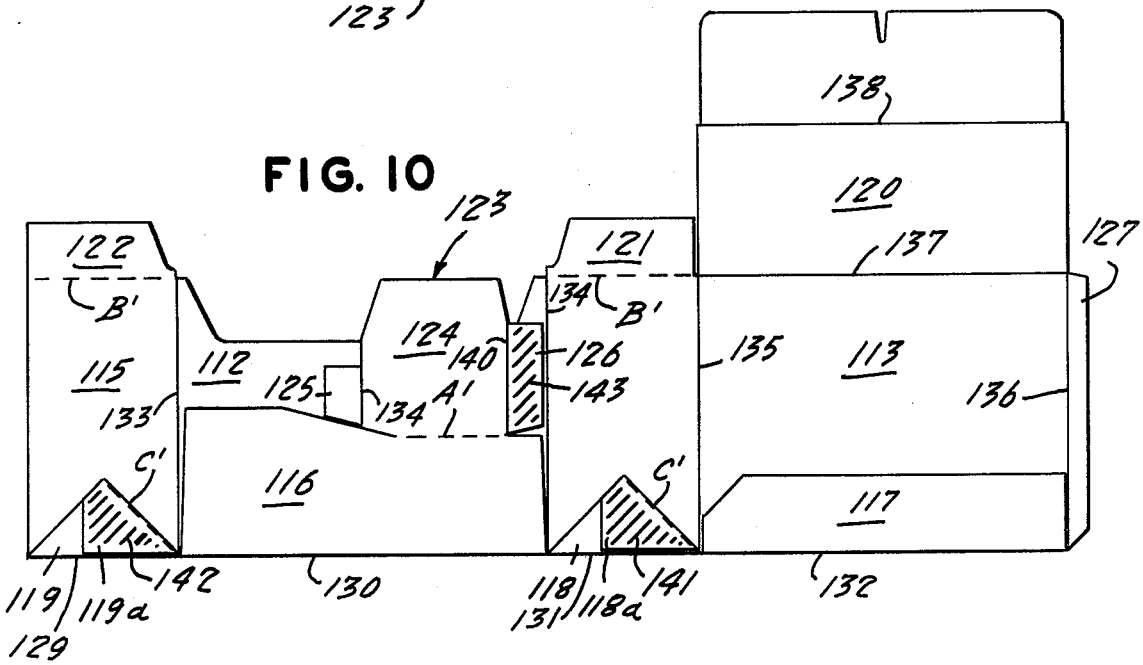

Turning to FIG. 10, folded flaps 118 and 119 are then folded along score lines 129 and 131 onto the upper surface of the blank, and bottom flap 116, with its attached divider panel means 123, is folded along score line 130 onto side wall panel 112 so that glue-bearing tab 125 adheres thereto. Also at this time, flap 117 is folded about score line 132 onto the upper surface of rear wall panel 113, and glue as indicated by stippling at 141, 142, and 143 is applied to upwardly facing surfaces of flap portions 118*a*, 119*a* and tab 126 respectively.

Figure 11:
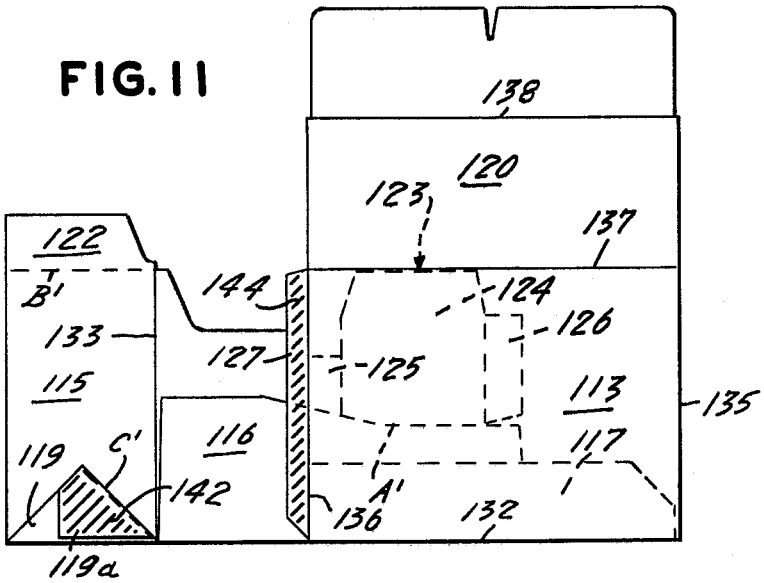

With reference to FIG. 11, wall panel 113 is folded about score line 135 from the position shown in FIG. 10 to the position shown in FIG. 11, carrying with it flaps 117 and 120, and flap 127, and adhering glue-bearing portion 118*a* of flap 118 (not shown) to a confronting portion of flap 117. Glue 144 is then applied to the upwardly facing surface of flap 127, whereupon wall panel 115 is folded to the right about score line 133, thereby adhering glue-bearing flap portion 119*a* to a confronting portion of flap 116 and glue-bearing flap 127 to wall panel 115 as is seen in FIG. 12.

Figure 12:
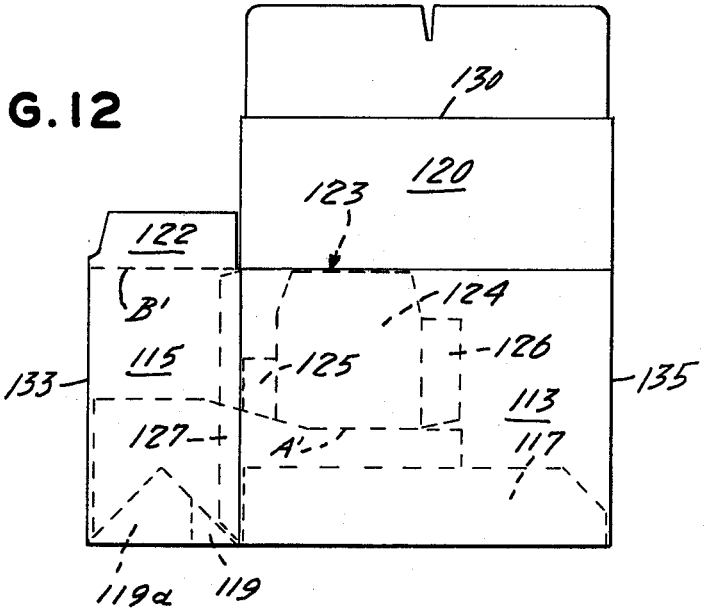

The finished carton as shown in FIG. 12 is seen from the rear in its folded mode, prior to its being unfolded to its set up or erected mode. In order better to describe an advantageous feature of the invention, divider panel means 123 is shown in broken lines in FIGS. 11 and 12.

Figure 7:
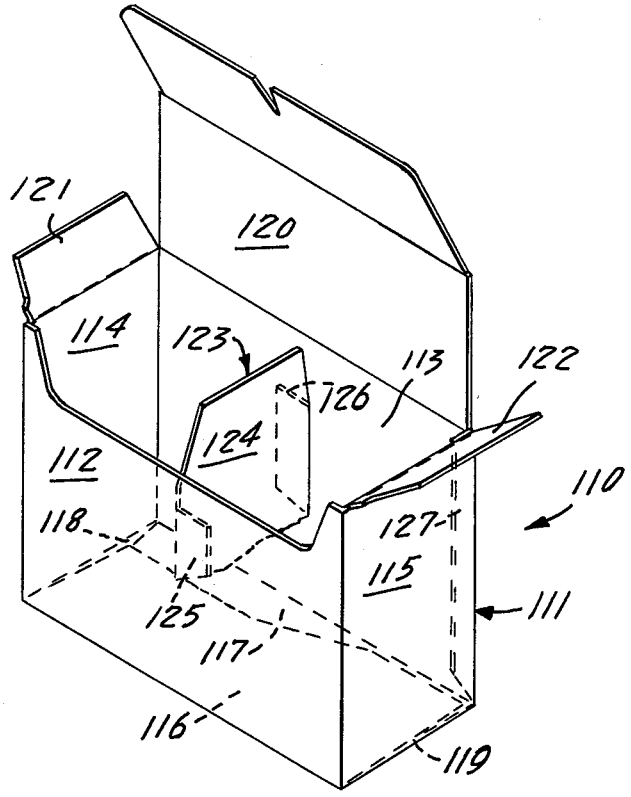
FIG. 7 is a perspective showing, similar to that of FIG. 1, of a completed carton in its set up mode and embodying a modified form of the invention.

In making the transition from the folded mode (FIG. 12) to the set up mode (FIG. 7), the left edge of wall panel 115 (e.g. score line 133) and the right edge of wall panel 113 (e.g. score line 135), as viewed in FIG. 12, are moved toward one another, so that the folded carton passes through a series of parallelogram-shaped cross sections, as viewed from above, until it attains the rectangular configuration of the set up mode as is seen in FIG. 7. In the course of this unfolding sequence, the intermediate region 124 of divider panel means 123 is caused to rotate about score lines 139 and 140 on hingedly connected tab end portions 125 and 126, to a position transverse wall panels 112 and 113. Since this movement of region or section 124 is relative to bottom flap 116, it is readily torn therefrom along the weakened, score line A'. Alternatively, section 124 may be detached manually or by suitable cutting means at any convenient stage of assembly after the adhesive attachment of tab 125 to wall panel 112 (FIG. 10).

Also upon setting up the carton, and aiding in separation of the divider panel section 124 from flap 116, folded flaps 118 and 119 pivot along their folded score lines C', in accordion-like manner similar to flaps 18 and 19 as discussed in connection with FIGS. 1 and 1A, and about score lines 131, 129. This pivotation of flaps 118 and 119 automatically pivots bottom flaps 116 and 117 glued thereto about the hinged connection afforded by score lines 130 and 132 into overlapping, substantially coplanar position transverse to the planes of wall panels 112, 113, 114 and 115.

Further to the hereinabove described embodiments, it is contemplated that in the carton blank shown in FIG. 2, divider panel means 23 alternatively may be detachably affixed to end closure flap 21, by a score line between tab 26 and the flap 21, and score line A would be a severed line in such a modification. In the assembly of such an alternative embodiment, end closure flap 21 would be folded about its score line B to carry divider panel means 23 into its position shown in FIG. 3. It is further contemplated that additional divider panel means may be provided, by duplicating any one of the disclosed divider panel locating means, or by providing combinations of such means.

While in any one of the hereinabove described embodiments adhesive is applied to the several tabs and flaps, it will be appreciated that in some instances it may be desirable to apply adhesive instead to regions of side wall panels and flaps that confront the aforesaid several tabs and flaps in the folded mode. In such instance, changes would be made as necessary in the blank folding sequence for assembling the carton.

It will be appreciated from the foregoing that the invention affords improved folding carton construction of the divided type fabricated from a single carton blank and characterized in that both the carton and its divider means are formed from the single blank in such a manner that the divider means is automatically positioned both in assembly of the carton to its folded mode and upon unfolding the carton to its set up mode.

While various embodiments of the invention have been illustrated and described, it will be appreciated that other modifications may be made without departing from the scope of the appended claims.

We claim:

1. In a folding, divided carton structure including a foldable sleeve-like body portion having confronting side wall panels that are relatively closely spaced in a folded mode of said carton structure and less closely spaced in a set up mode of said carton structure, and a closure portion hingedly connected to said body portion, the combination of divider means for said body portion, comprising: at least one divider panel; means defining hinged connection of each of a pair of mutually spaced regions of said divider panel to one of said confronting side wall panels; and means defining detachable interconnection between said divider panel and one of said body and closure portions in the recited folded mode of said carton structure, said means defining hinged connection and said means defining detachable interconnection being so cooperably disposed that, upon unfolding said carton structure to the recited set up mode, said divider panel is pivotable on said hingedly connected spaced regions to release said detachable interconnection and move to a position dividing the region enclosed by said sleeve-like body portion.

2. A carton structure according to claim 1, and characterized in that said closure portion is so disposed and hingedly connected to said body portion as to be pivotable into carton closing position upon the recited unfolding of said carton structure to a set up mode.

3. A carton structure according to claim 1, and characterized in that said detachable interconnection is between a side wall panel.

4. A carton structure according to claim 3, and characterized in that said closure portion is so disposed and hingedly connected to said body portion as to be pivotable into carton closing position upon the recited unfolding of said carton structure to a set up mode.

5. A carton structure according to claim 1, and characterized in that said detachable interconnection is between said divider panel and said closure portion.

6. A carton structure according to claim 5, and characterized in that said closure portion is so disposed and hingedly connected to said body portion as to be pivotable into carton closing position upon the recited unfolding of said carton structure to a set up mode.

7. A carton structure according to claim 1, and characterized by the inclusion of a pair of tab means each hingedly connected to said divider panel in one of said mutually spaced regions and attached to said side wall panels in provision of the recited hinged connection.

8. A carton structure according to claim 7, and characterized in that said detachable interconnection is between a side wall panel of said body portion and said divider panel.

9. A carton structure according to claim 7, and characterized in that said detachable interconnection is between said divider panel and said closure portion.

10. A carton structure according to claim 7, and characterized in that said closure portion is so disposed and hingedly connected to said body portion as to be pivotable into carton closing position upon the recited unfolding of said carton structure to a set up mode.

11. A carton structure according to claim 10, and characterized further in that said detachable interconnection is between said divider panel and said foldable closure portion.

12. A carton structure according to claim 10, and characterized further in that said detachable interconnection is between a side wall panel of said body portion and said divider panel.

13. In a folding carton structure of the type including side wall panels, at least a pair of said side wall panels being disposed in closely spaced, confronting relation in a folded mode of said carton structure, and movable apart to a more distantly spaced confronting relation in provision of a set up mode of said carton structure, means for dividing said structure comprising: a divider panel; means defining a pair of mutually spaced regions on said divider panel, one of said spaced regions being hingedly connected to one side wall panel of said pair, and the other of said spaced regions being hingedly connected to the other side wall panel of said pair; and means defining a section on said divider panel extending between said spaced regions and detachably interconnected with one of said side wall panels, in the recited folded mode of said carton structure, the recited section, upon unfolding said carton structure to a set up mode, further being pivotable on said hingedly connected spaced regions, and thereby detachable from the recited interconnection, to a position dividing the region enclosed by said side wall panels.

14. A folding carton structure according to claim 13, and characterized in that said section on said divider panel is detachably interconnected along a line of weakness interposed said divider panel and said one side panel portion.

* * * * *

UNITED STATES PATENT AND TRADEMARK OFFICE

CERTIFICATE OF CORRECTION

PATENT NO. : 4,105,154

DATED : August 8, 1978

INVENTOR(S) : George L. Meyers et al

It is certified that error appears in the above-identified patent and that said Letters Patent are hereby corrected as shown below:

Claim 3 of the patent reads as follows:

A carton structure according to claim 1, and characterized in that said detachable interconnection is between a side wall panel of said body portion and said divider panel.

Signed and Sealed this

*Twenty-fourth* Day of *June 1980*

[SEAL]

*Attest:*

SIDNEY A. DIAMOND

*Attesting Officer*

*Commissioner of Patents and Trademarks*